US011620955B2

(12) United States Patent
Lee et al.

(10) Patent No.: US 11,620,955 B2
(45) Date of Patent: Apr. 4, 2023

(54) DISPLAY APPARATUS AND METHOD OF DRIVING THE SAME

(71) Applicant: Samsung Display Co., LTD., Yongin-si (KR)

(72) Inventors: Chang-Soo Lee, Suwon-si (KR); Boyong Chung, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/737,910

(22) Filed: May 5, 2022

(65) Prior Publication Data

US 2022/0358885 A1 Nov. 10, 2022

(30) Foreign Application Priority Data

May 6, 2021 (KR) ..... 10-2021-0058808

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0452* (2013.01); *G09G 2300/0842* (2013.01); *G09G 2310/027* (2013.01)

(58) Field of Classification Search
None
See application file for complete search history.

(56) References Cited

U.S. PATENT DOCUMENTS

| | | | | |
|---|---|---|---|---|
| 10,171,799 | B2 | 1/2019 | Ono | |
| 2015/0187268 | A1* | 7/2015 | Tani | G09G 3/3233 345/77 |
| 2017/0148385 | A1* | 5/2017 | Kishi | G09G 3/3291 |
| 2018/0075798 | A1* | 3/2018 | Nho | G09G 3/32 |
| 2021/0383763 | A1* | 12/2021 | Kim | H01L 27/3276 |

FOREIGN PATENT DOCUMENTS

| | | |
|---|---|---|
| KR | 10-1101127 | 12/2011 |
| KR | 10-2014-0022899 | 2/2014 |

* cited by examiner

*Primary Examiner* — Sepehr Azari
(74) *Attorney, Agent, or Firm* — H.C. Park & Associates, PLC

(57) ABSTRACT

A display apparatus includes a display panel, a gate driver, a data driver and a driving controller. The display panel includes a gate line, a data line, a sensing line and a subpixel connected to the gate line, the data line and the sensing line. The gate outputs a gate signal to the gate line. The data driver outputs a data voltage to the data line. The driving controller controls the gate driver and the data driver. The display panel includes a first color subpixel, a second color subpixel and a third color subpixel. The driving controller is configured to determine a sensing target gate line among a plurality of gate lines based on first color data corresponding to the first color subpixel, second color data corresponding to the second color subpixel and third color data corresponding to the third color subpixel.

20 Claims, 9 Drawing Sheets

| GATE LINE | GR1 | GG1 | GB1 |
|---|---|---|---|
| 1 | 70% | 20% | 10% |
| 2 | 60% | 20% | 20% |
| 3 | 20% | 70% | 10% |
| ⋮ | ⋮ | ⋮ | ⋮ |
| 2160 | 30% | 40% | 30% |

| GATE LINE | GR1 | GG1 | GB1 |
|---|---|---|---|
| 1 | 70% | 20% | 10% |
| 2 | 60% | 20% | 20% |
| 3 | 20% | 70% | 10% |
| ⋮ | ⋮ | ⋮ | ⋮ |
| 2160 | 30% | 40% | 30% |

| GATE LINE | GR2 | GG2 | GB2 |
|---|---|---|---|
| 1 | 150 | 0 | 0 |
| 2 | 130 | 20 | 15 |
| 3 | 15 | 200 | 180 |
| ⋮ | ⋮ | ⋮ | ⋮ |
| 2160 | 255 | 255 | 0 |

FIG. 13

| GATE LINE | PR1 | PG1 | PB1 |
|---|---|---|---|
| 1 | 30% | 40% | 30% |
| 2 | 10% | 80% | 10% |
| 3 | 60% | 20% | 20% |
| ⋮ | ⋮ | ⋮ | ⋮ |
| 2160 | 70% | 20% | 10% |

FIG. 14

| GATE LINE | PR2 | PG2 | PB2 |
|---|---|---|---|
| 1 | 250 | 140 | 90 |
| 2 | 20 | 350 | 470 |
| 3 | 350 | 80 | 160 |
| ⋮ | ⋮ | ⋮ | ⋮ |
| 2160 | 60 | 30 | 20 |

DISPLAY APPARATUS AND METHOD OF DRIVING THE SAME

CROSS REFERENCE TO RELATED APPLICATION

This application claims priority from and the benefit of Korean Patent Application No. 10-2021-0058808, filed on May 6, 2021, which is hereby incorporated by reference for all purposes as if fully set forth herein.

BACKGROUND

Field

Embodiments of the inventive concepts relate generally to a display apparatus and a method of driving the display apparatus and, more specifically, to embodiments of the inventive concepts relate to a display apparatus determining a sensing horizontal line according to input image data and a method of driving the display apparatus.

Discussion of the Background

Generally, a display apparatus includes a display panel and a display panel driver. The display panel includes a plurality of gate lines, a plurality of data lines and a plurality of subpixels. The display panel driver includes a gate driver and a data driver. The gate driver outputs gate signals to the gate lines. The data driver outputs data voltages to the data lines. The display panel driver further includes a sensing part that receives a sensing signal from the subpixel.

In a writing mode, the data driver may output a data voltage to the display panel. In a sensing mode, the data driver may output a sensing data voltage to the display panel. In the sensing mode, the sensing part may determine a degree of deterioration of a light emitting element of the subpixel or an electrical characteristic of a switching element of the subpixel by sensing a voltage of the subpixel.

The determination of the degree of deterioration of the light emitting element of the subpixel or the electrical characteristic of the switching element of the subpixel may not be accurate according to an image displayed on the display panel and a pixel structure of the display panel.

When the determination of the degree of deterioration of the light emitting element of the subpixel or the electrical characteristic of the switching element of the subpixel is not accurate, the data signal may be erroneously compensated so that the display quality of the display panel may be deteriorated.

The above information disclosed in this Background section is only for understanding of the background of the inventive concepts, and, therefore, it may contain information that does not constitute prior art.

SUMMARY

Devices constructed according to illustrative implementations of the invention and method for forming such devices are capable of providing a precise degree of deterioration of a light emitting element of a subpixel or an electrical characteristic of a switching element of a subpixel of a display device, in order to provide an accurate compensation signal in order to enhance a display quality of the display device.

Embodiments provide a display apparatus that is configured to determine a sensing horizontal line according to input image data to enhance a display quality of a display panel.

Embodiments also provide a method of driving the display apparatus.

Additional features of the inventive concepts will be set forth in the description which follows, and in part will be apparent from the description, or may be learned by practice of the inventive concepts.

In an embodiment of a display apparatus, the display apparatus includes a display panel, a gate driver, a data driver and a driving controller. The display panel includes a gate line, a data line, a sensing line and a subpixel connected to the gate line, the data line and the sensing line. The gate driver is configured to output a gate signal to the gate line. The data driver is configured to output a data voltage to the data line. The driving controller is configured to control the gate driver and the data driver. The display panel includes a first color subpixel, a second color subpixel and a third color subpixel. The driving controller is configured to determine a sensing target gate line among a plurality of gate lines of the display panel based on first color data corresponding to the first color subpixel, second color data corresponding to the second color subpixel and third color data corresponding to the third color subpixel.

In an embodiment, the sensing line may overlap the first color subpixel.

In an embodiment, the driving controller may be configured to determine a ratio of grayscale data of the first color data, a ratio of grayscale data of the second color data and a ratio of grayscale data of the third color data in each gate line.

In an embodiment, the driving controller may be configured to determine a gate line having a lowest ratio of the grayscale data of the first color data among all the gate lines as a first sensing target gate line in a first frame.

In an embodiment, the driving controller may be configured to determine a gate line having a lowest ratio of the grayscale data of the first color data among all the gate lines except for the first sensing target gate line as a second sensing target gate line in a second frame.

In an embodiment, the driving controller may be configured to determine an average value of grayscale data of the first color data, an average value of grayscale data of the second color data and an average value of grayscale data of the third color data in each gate line.

In an embodiment, the driving controller may be configured to determine a ratio of a number of the first color subpixels among subpixels having a grayscale value equal to or greater than a threshold grayscale value, a ratio of a number of the second color subpixels among the subpixels having a grayscale value equal to or greater than the threshold grayscale value and a ratio of a number of the third color subpixels among the subpixels having a grayscale value equal to or greater than the threshold grayscale value in each gate line.

In an embodiment, the driving controller may be configured to determine a number of the first color subpixels among subpixels having a grayscale value equal to or greater than a threshold grayscale value, a number of the second color subpixels among the subpixels having a grayscale value equal to or greater than the threshold grayscale value and a number of the third color subpixels among the subpixels having a grayscale value equal to or greater than the threshold grayscale value in each gate line.

In an embodiment, the first color subpixel may be a red subpixel. The second color subpixel may be a green subpixel. The third color subpixel may be a blue subpixel.

In an embodiment, the first color subpixel may be a green subpixel. The second color subpixel may be a red subpixel. The third color subpixel may be a blue subpixel.

In an embodiment, the first color subpixel may be a blue subpixel. The second color subpixel may be a red subpixel. The third color subpixel may be a green subpixel.

In an embodiment, the sensing line may overlap the first color subpixel and the second color subpixel.

In an embodiment, the driving controller may be configured to determine a ratio of grayscale data of the first color data, a ratio of grayscale data of the second color data and a ratio of grayscale data of the third color data in each gate line. The driving controller may be configured to determine a gate line having a lowest sum of the ratio of the grayscale data of the first color data and the ratio of the grayscale data of the second color data among all the gate lines as a first sensing target gate line in a first frame.

In an embodiment, the subpixel may include a first transistor configured to apply a first power voltage to a second node in response to a signal at a first node, a second transistor configured to output the data voltage to the first node in response to a first signal, a third transistor configured to output a signal at the second node to the sensing line in response to a second signal, a storage capacitor including a first end portion connected to the first node and a second end portion connected to the second node and a light emitting element including a first electrode connected to the second node and a second electrode configured to receive a second power voltage.

In an embodiment, the display apparatus may further include an initialization switch configured to apply a sensing initialization voltage to the sensing line. The first signal may have an active level and the second signal may have an inactive level in a writing mode. The first signal may have the active level and the second signal may have an active level and the third signal may have an inactive level in a sensing mode.

In an embodiment, the display apparatus may be driven in a unit of a frame. The frame may include an active period and a vertical blank period. The subpixel may be sensed during the vertical blank period.

In an embodiment of a method of driving a display apparatus according to the present inventive concept, the method includes outputting a gate signal to a gate line of a display panel including a first color subpixel, a second color subpixel and a third color subpixel, outputting a data voltage to a data line of the display panel, determining a sensing target gate line among a plurality of gate lines of the display panel based on first color data corresponding to the first color subpixel, second color data corresponding to the second color subpixel and third color data corresponding to the third color subpixel, receiving a sensing signal from a sensing line of a subpixel corresponding to the sensing target gate line and compensating a data signal based on the sensing signal.

In an embodiment, the sensing line may overlap the first color subpixel.

In an embodiment, the method may further include determining a ratio of grayscale data of the first color data, a ratio of grayscale data of the second color data and a ratio of grayscale data of the third color data in each gate line.

In an embodiment, a gate line having a lowest ratio of the grayscale data of the first color data among all the gate lines may be determined as a first sensing target gate line in a first frame.

According to the display apparatus and the method of driving the display apparatus, the input image data may be analyzed to determine the sensing horizontal line which is a sensing target so that the accuracy of the sensing and the accuracy of the image compensation may be enhanced.

For example, in a pixel structure in which the red subpixel overlaps the sensing line, the horizontal line having the low data density of the red subpixel is determined as the sensing horizontal line so that the accuracy of the sensing and the accuracy of the image compensation may be enhanced. Thus, the display quality of the display panel may be enhanced.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

FIG. 13 is a conceptual diagram illustrating an image analysis table generated by a driving controller of a display apparatus according to an embodiment.

FIG. 14 is a conceptual diagram illustrating an image analysis table generated by a driving controller of a display apparatus according to an embodiment.

DETAILED DESCRIPTION

Figure 1:
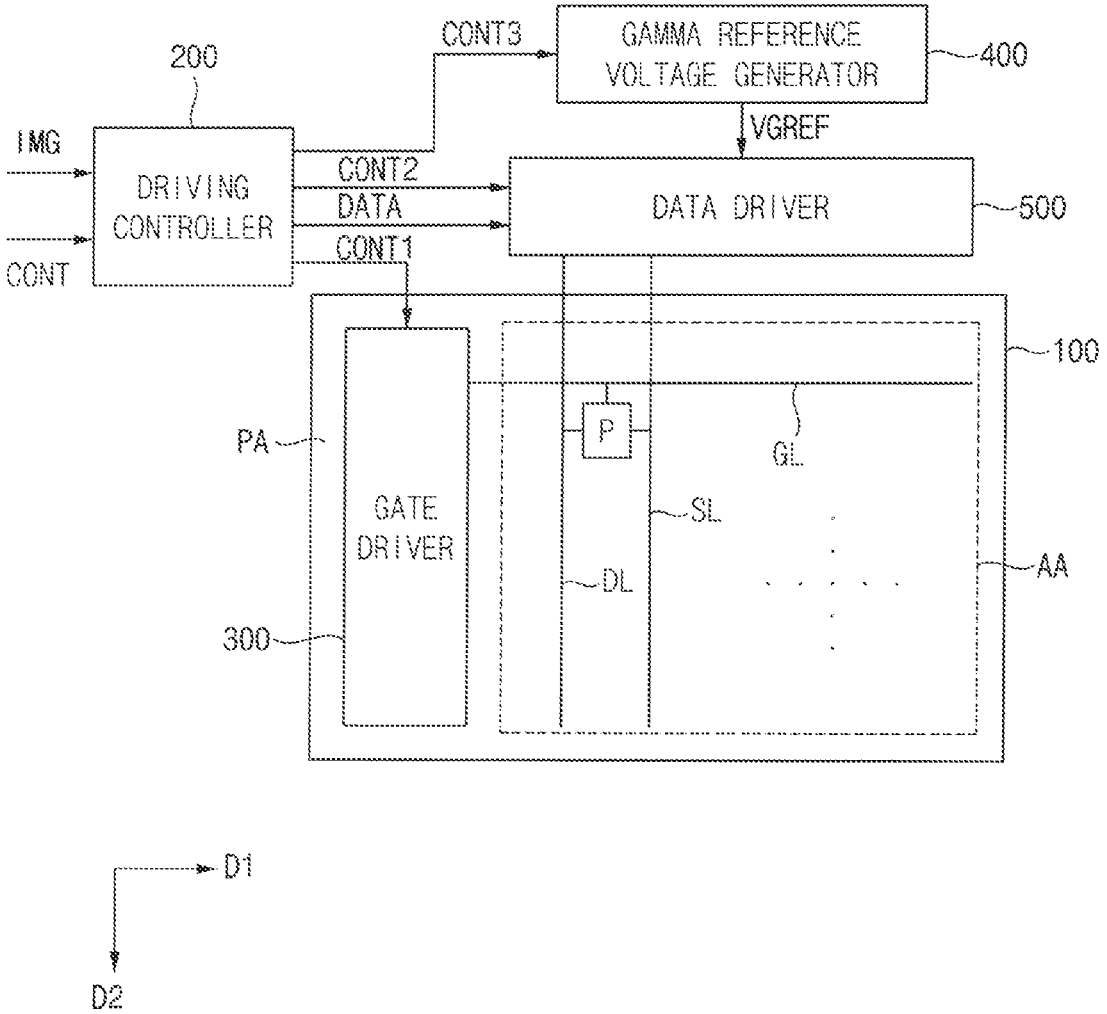
FIG. 1 is a block diagram illustrating a display apparatus according to an embodiment that is constructed according to principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, various embodiments will be explained in detail with reference to the accompanying drawings.

FIG. 1 is a block diagram illustrating a display apparatus according to an embodiment.

Referring to FIG. 1, the display apparatus includes a display panel 100 and a display panel driver. The display panel driver includes a driving controller 200, a gate driver 300, a gamma reference voltage generator 400 and a data driver 500.

For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 that are integrally formed may be referred to as a timing controller embedded data driver (TED).

The display panel 100 has a display region AA on which an image is displayed and a peripheral region PA adjacent to the display region AA.

For example, in the embodiment described herein, the display panel 100 may be an organic light emitting diode display panel including an organic light emitting diode. For example, the display panel 100 may be a quantum dot organic light emitting diode display panel including an organic light emitting diode and a quantum dot color filter. For example, the display panel 100 may be a quantum dot nano light emitting diode display panel including a nano light emitting diode and a quantum dot color filter. Alternatively, the display panel 100 may be a liquid crystal display panel including a liquid crystal layer.

The display panel 100 includes a plurality of gate lines GL, a plurality of data lines DL and a plurality of subpixels P connected to the gate lines GL and the data lines DL. The gate lines GL extend in a first direction D1 and the data lines DL extend in a second direction D2 crossing the first direction D1.

In the embodiment described herein, the display panel 100 may further include a plurality of sensing lines SL connected to the subpixels P. The sensing lines SL may extend in the second direction D2.

In the embodiment described herein, the display panel driver may include a sensing part receiving a sensing signal from the subpixels P of the display panel 100 through sensing lines SL. The sensing part may be disposed in the data driver 500. When the data driver 500 has an integrated chip (IC) type, the sensing part may be disposed in a data driving IC. Alternatively, the sensing part may be formed independently from the data driver 500. However, the features of the embodiment described herein may not be limited to a position of the sensing part.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

In the embodiment described herein, for example, the display panel 100 may include a first color subpixel, a second color subpixel and a third color subpixel. The driving controller 200 may determine a sensing target gate line among all of the gate lines based on first color data corresponding to the first color subpixel, second color data corresponding to the second color subpixel and third color data corresponding to the third color subpixel.

In addition, the driving controller 200 may compensate the data signal DATA based on the sensing signal received through the sensing line SL.

The gate driver 300 generates gate signals that drive the gate lines GL in response to the first control signal CONT1 received from the driving controller 200. The gate driver 300 outputs the gate signals to the gate lines GL. For example, the gate driver 300 may sequentially output the gate signals to the gate lines GL.

In the embodiment described herein, the gate driver 300 may output a gate signal to the sensing target gate line in a sensing mode.

In an embodiment, the gate driver 300 may be integrated on the peripheral region PA of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
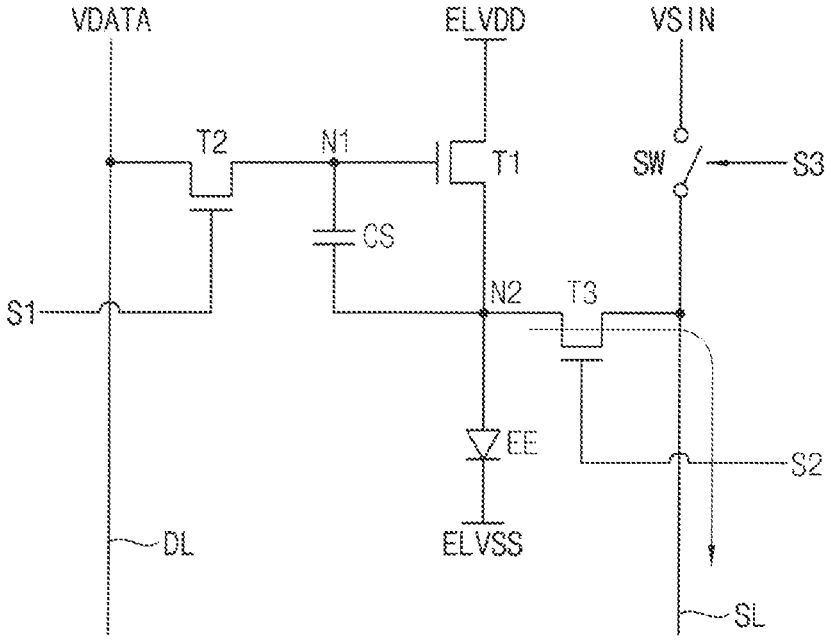
FIG. 2 is a circuit diagram illustrating a subpixel of FIG. 1.

FIG. 2 is a circuit diagram illustrating the subpixel P of FIG. 1.

Referring to FIGS. 1 and 2, the subpixel P may include a first transistor T1 applying a first power voltage ELVDD to a second node N2 in response to a signal at a first node N1, a second transistor T2 outputting the data voltage VDATA to the first node N1 in response to a first signal S1, a third transistor T3 outputting a signal at the second node N2 to a sensing node in response to a second signal S2, a storage capacitor CS including a first end portion connected to the first node N1 and a second end portion connected to the second node N2 and a light emitting element EE including a first electrode connected to the second node N2 and a second electrode receiving a second power voltage ELVSS.

Herein, the second power voltage ELVSS may be less than the first power voltage ELVDD. For example, the light emitting element may be an organic light emitting diode (OLED).

The display apparatus may further include an initialization switch SW applying a sensing initialization voltage VSIN to the sensing line SL. The initialization switch SW may be turned on and turned off based on a third signal S3. For example, the initialization switch SW may be disposed on the display panel 100. Alternatively, the initialization switch SW may be disposed in the sensing part.

Figure 3:
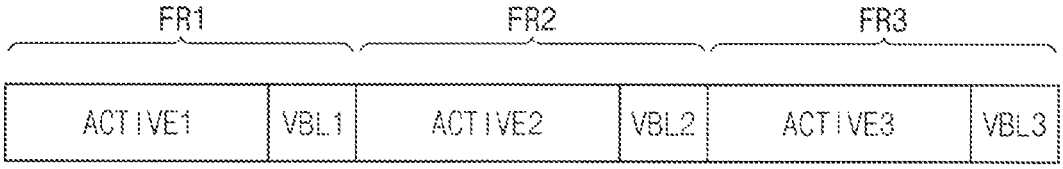
FIG. 3 is a conceptual diagram illustrating a driving timing of the display apparatus of FIG. 1.

FIG. 3 is a conceptual diagram illustrating a driving timing of the display apparatus of FIG. 1.

Referring to FIGS. 1 to 3, the display apparatus may be driven in a unit of a frame. The frame FR1, FR2 and FR3 may include an active period ACTIVE1, ACTIVE2 and ACTIVE3 and a vertical blank period VBL1, VBL2 and VBL3. The data voltages VDATA may be applied to the subpixels P of the display panel 100 in the active period ACTIVE1, ACTIVE2 and ACTIVE3. The data voltages VDATA may not be applied to the subpixels P of the display panel 100 in the vertical blank period VBL1, VBL2 and VBL3.

For example, a sensing period may be disposed in the vertical blank period VBL1, VBL2 and VBL3. For example, a sensing signal of the display panel 100 may be sensed during a first vertical period VBL1 and a data voltage which is compensated using the sensing signal sensed during the first vertical period VBL1 may be written to the subpixels P during a second active period ACTIVE2. For example, a sensing signal of the display panel 100 may be sensed during a second vertical period VBL2 and a data voltage which is compensated using the sensing signal sensed during the second vertical period VBL2 may be written to the subpixels P during a third active period ACTIVE3.

For example, sensing signals of color subpixels having the same color corresponding to one sensing target gate line may be sensed during one vertical blank period. For example, sensing signals of first color subpixels connected to a first gate line may be sensed during a first vertical blank period VBL1 of a first frame FR1, sensing signals of second color subpixels connected to the first gate line may be sensed during a second vertical blank period VBL2 of a second frame FR2 and sensing signals of third color subpixels connected to the first gate line may be sensed during a third vertical blank period VBL3 of a third frame FR3.

For example, when a number of all gate lines of the display panel 100 is 2160 and the display panel 100 includes color subpixels of three colors, 2160*3 frames may be required to receive sensing signals from all subpixels of the display panel 100.

Figure 4:
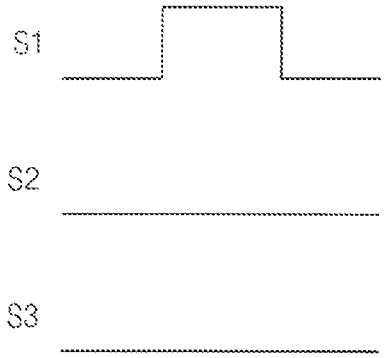
FIG. 4 is a timing diagram illustrating input signals of the subpixel of FIG. 2 in a writing mode.
Figure 5:
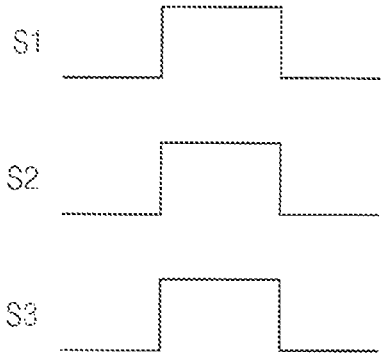
FIG. 5 is a timing diagram illustrating input signals of the subpixel of FIG. 2 in a sensing initialization mode.
Figure 6:
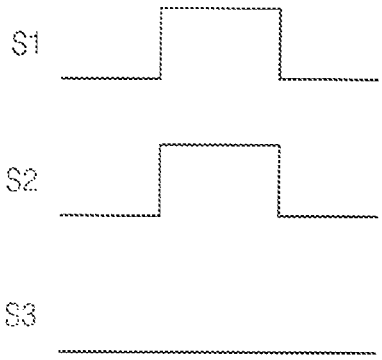
FIG. 6 is a timing diagram illustrating input signals of the subpixel of FIG. 2 in a sensing mode.

FIG. 4 is a timing diagram illustrating input signals of the subpixel of FIG. 2 in a writing mode. FIG. 5 is a timing diagram illustrating input signals of the subpixel of FIG. 2 in a sensing initialization mode. FIG. 6 is a timing diagram illustrating input signals of the subpixel of FIG. 2 in a sensing mode.

Referring to FIGS. 1 to 6, the data driver 500 may operate in a writing mode and in a sensing mode. In the writing mode, the data voltage VDATA for displaying an image may be written to the subpixels P of the display panel 100. In the sensing mode, an electrical characteristic of the subpixel P may be sensed.

The writing mode may operate in the active period. For example, the first signal S1 may have an active level and the second signal S2 may have an inactive level in the writing mode. In the writing mode, the second transistor T2 may be turned on so that the data voltage VDATA may be written to the storage capacitor CS.

In the sensing initialization mode, the sensing initialization voltage VSIN is applied to the second node N2 prior to the sensing mode. For example the sensing initialization mode may operate in the vertical blank period. In the sensing initialization mode, the second signal S2 and the third signal S3 may be activated so that the sensing initialization mode may be applied to the second node N2. In the sensing initialization mode, the third transistor T3 and the initialization switch SW may be turned on so that the sensing initialization voltage VSIN may be applied to the second node N2.

For example, in the sensing initialization mode, all of the first signal S1, the second signal S2 and the third signal S3 may be activated.

The sensing mode may operate in the vertical blank period. For example, in the sensing mode, the second signal S2 may have an active level and the third signal S3 may have an inactive level. For example, in the sensing mode, the first signal S1 may also have an active level.

In the sensing mode, the first signal S1 may be activated so that the data voltage VDATA may be applied to the first node N1 through the second transistor T2. Herein, the data voltage VDATA may be a sensing data voltage for sensing the electrical characteristic of the first transistor T1. For example, the electrical characteristic of the first transistor T1 may be a mobility of the first transistor T1. For example, the electrical characteristic of the first transistor T1 may be a threshold voltage of the first transistor T1. The data voltage VDATA may be a sensing data voltage for sensing an electrical characteristic of the light emitting element EE. For example, the electrical characteristic of the light emitting element EE may be a capacitance between both electrodes of the light emitting element EE.

The first transistor T1 may be turned on by the sensing data voltage applied to the first node N1 in the sensing mode and the sensing initialization voltage VSIN applied to the second node N2 in the sensing initialization mode.

In addition, the second signal S2 is activated in the sensing mode so that the third transistor T3 is turned on in the sensing mode. Accordingly, the sensing signal of the second node N2 may be outputted to the sensing line SL through the third transistor T3 in the sensing mode.

The sensing line SL is connected to the sensing part and the sensing part may include an analog to digital converter. The analog to digital converter may convert the sensing signal of the second node N2 to a digital sensing signal.

The third signal S3 is inactivated in the sensing mode so that the sensing initialization voltage VSIN may not be outputted to the sensing node in the sensing mode.

The driving controller 200 may compensate the data signal applied to the subpixel according to the sensing signal and output the compensated data signal to the data driver 500. The data driver 500 may output the data voltage VDATA compensated based on the sensing signal to the data line DL.

Figure 7:
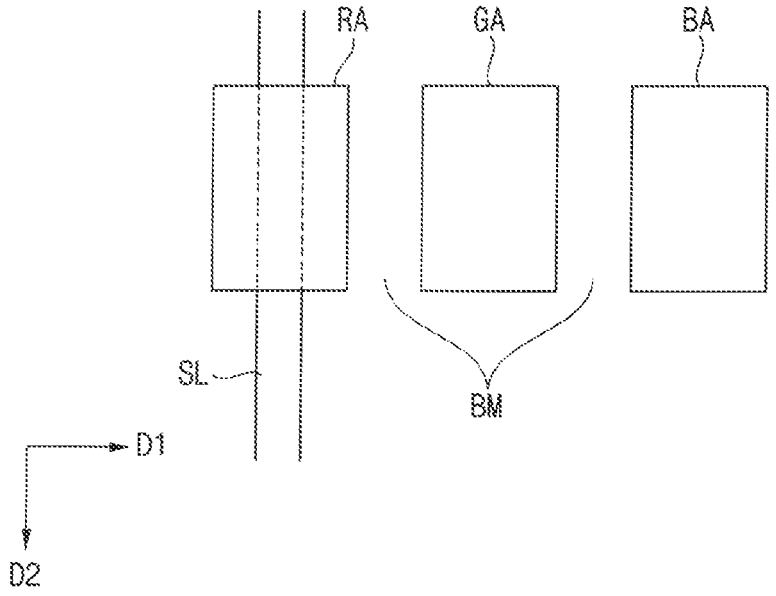
FIG. 7 is a conceptual diagram illustrating an arrangement of the subpixels and a sensing line of the display panel of FIG. 1.

FIG. 7 is a conceptual diagram illustrating an arrangement of the subpixels and the sensing line SL of the display panel 100 of FIG. 1.

Referring to FIGS. 1 to 7, the display panel 100 may include a first color subpixel, a second color subpixel and a third color subpixel. For example, the first color subpixel may be a red subpixel, the second color subpixel may be a green subpixel and the third color subpixel may be a blue subpixel. In a pixel row of the display panel 100, the first color subpixel, the second color subpixel and the third color subpixel may be sequentially and repetitively disposed along a first direction D1.

In FIG. 7, a light emitting area of the red subpixel is represented to RA, a light emitting area of the green subpixel is represented to GA and a light emitting area of the blue subpixel is represented to BA. A light blocking area BM may be disposed between the light emitting area RA of the red subpixel, the light emitting area GA of the green subpixel and the light emitting area BA of the blue subpixel. In the embodiment described herein, the sensing line SL may overlap the red subpixel. For example, the sensing line SL may overlap the light emitting area RA of the red subpixel.

As shown in FIG. 7, in the embodiment described herein, one sensing line SL may be formed for one red subpixel, one green subpixel and one blue subpixel. The sensing line SL may be connected to the red subpixel, the green subpixel and the blue subpixel to receive the sensing signal from the red subpixel, the green subpixel and the blue subpixel.

When the sensing line SL overlaps the light emitting area RA of the red subpixel, accuracy of data compensation by the real time sensing may decrease due to capacitance formed between an anode of a light emitting element of the red sub-pixel and the sensing line SL. In addition, when a grayscale value of red color data is high, the display quality may be further deteriorated due to the inaccuracy of the data compensation.

Figure 8:
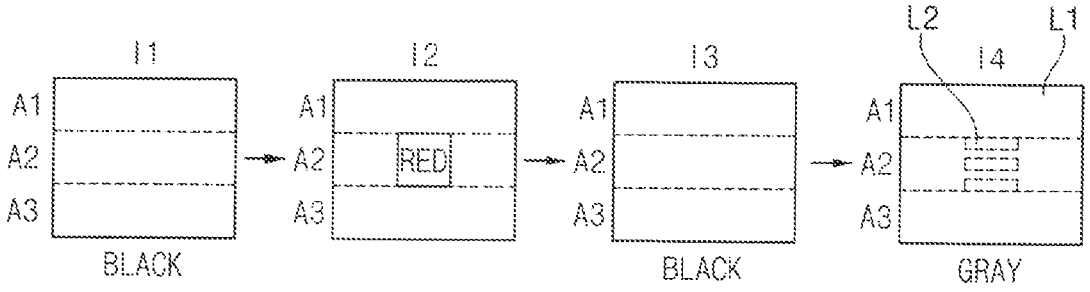
FIG. 8 is a conceptual diagram illustrating a display defect of a display panel in a comparative embodiment when a first image, a second image, a third image and a fourth image are sequentially displayed on the display panel.

FIG. 8 is a conceptual diagram illustrating a display defect of a display panel in a comparative embodiment when a first image I1, a second image I2, a third image I3 and a fourth image I4 are sequentially displayed on the display panel.

In FIG. 8, the first image I1 and the third image I3 may be a black image. The second image I2 includes a red box pattern RED in a black background. The fourth image I4 is a gray image. An upper portion A1 of the second image I2 and a lower portion A3 of the second image I2 may include a black image. However, a middle portion A2 of the second image I2 may include the red box pattern RED.

Each of the first image I1, the second image I2, the third image I3 and the fourth image I4 may be displayed for a predetermined time (e.g. for several frames or for several tens of frames). The first image I1, the second image I2, the third image I3 and the fourth image I4 may be sequentially displayed.

When the sensing is performed on the middle portion A2 of the second image I2 including the red box pattern RED in the pixel structure in which the red sub-pixel overlaps the sensing line SL as shown in FIG. 7, and the data voltage is compensated based on the sensing signal, the accuracy of the compensation may decrease.

In the fourth image I4 in FIG. 8, a portion of the second image I2 which is not affected by the red box pattern RED of the second image I2 may represent a first luminance L1 but a portion of the second image I2 which is erroneously compensated by the red box pattern RED of the second image I2 may represent a second luminance L2 different from the first luminance L1. The first luminance L1 may be a desired luminance of the fourth image I4. The second luminance L2 may not be the desired luminance of the fourth image I4.

Figures 9, 10:
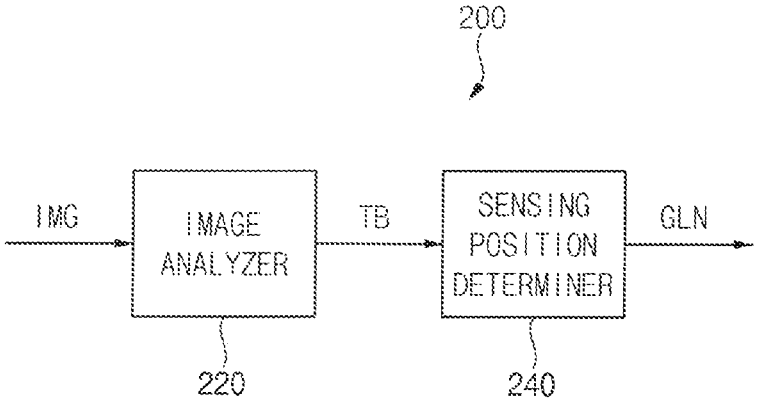
FIG. 9 is a block diagram illustrating a driving controller of FIG. 1.
FIG. 10 is a conceptual diagram illustrating an image analysis table generated by the driving controller of FIG. 1.
Figures 11, 12:
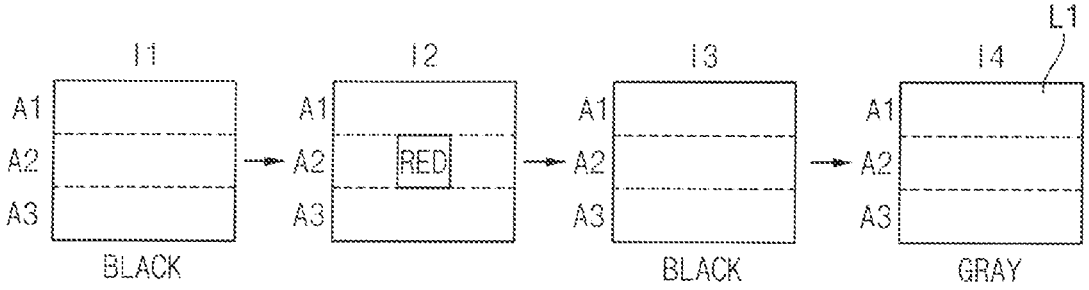
FIG. 11 is a conceptual diagram illustrating a display image of the display panel of FIG. 1 when a first image, a second image, a third image and a fourth image are sequentially displayed on the display panel.
FIG. 12 is a conceptual diagram illustrating an image analysis table generated by a driving controller of a display apparatus according to an embodiment.

FIG. 9 is a block diagram illustrating the driving controller 200 of FIG. 1. FIG. 10 is a conceptual diagram illustrating an image analysis table TB generated by the driving controller 200 of FIG. 1. FIG. 11 is a conceptual diagram illustrating a display image of the display panel 100 of FIG. 1 when the first image I1, the second image I2, the third image I3 and the fourth image I4 are sequentially displayed on the display panel 100.

Referring to FIGS. 9 to 11, the driving controller 200 may determine the sensing target gate line among all of the gate lines based on the first color data corresponding to the first color subpixel, the second color data corresponding to the second color subpixel and the third color data corresponding to the third color subpixel.

For example, the driving controller 200 may include an image analyzer 220 analyzing the input image data IMG and generating the image analysis table TB and a sensing position determiner 240 determining the sensing target gate line GLN based on the image analysis table TB.

The image analyzer 220 may determine a data density. The image analyzer 220 may determine a ratio GR1 of grayscale data of the first color data, a ratio GG1 of grayscale data of the second color data and a ratio GB1 of grayscale data of the third color data in each gate line. For example, the first color data may be red color data, the second color data may be green color data and the third color data may be blue color data. The ratio GR1 of grayscale data of the first color data, the ratio GG1 of grayscale data of the second color data and the ratio GB1 of grayscale data of the third color data respectively represent relative ratios of the red grayscale values, the green grayscale values, the blue grayscale values in the gate line as a percentage.

In FIG. 10, a ratio GR1 of grayscale data of the red subpixel connected to a first gate line, a ratio GG1 of grayscale data of the green subpixel connected to the first gate line, a ratio GB1 of grayscale data of the blue subpixel connected to the first gate line may be respectively 70%, 20% and 10%.

In FIG. 10, a ratio GR1 of grayscale data of the red subpixel connected to a second gate line, a ratio GG1 of grayscale data of the green subpixel connected to the second gate line, a ratio GB1 of grayscale data of the blue subpixel connected to the second gate line may be respectively 60%, 20% and 20%.

In FIG. 10, a ratio GR1 of grayscale data of the red subpixel connected to a third gate line, a ratio GG1 of grayscale data of the green subpixel connected to the third gate line, a ratio GB1 of grayscale data of the blue subpixel connected to the third gate line may be respectively 20%, 70% and 10%.

In FIG. 10, a ratio GR1 of grayscale data of the red subpixel connected to a 2160-th gate line, a ratio GG1 of grayscale data of the green subpixel connected to the 2160-th gate line, a ratio GB1 of grayscale data of the blue subpixel connected to the 2160-th gate line may be respectively 30%, 40% and 30%.

In the embodiment described herein, the sensing line SL overlaps the red subpixel so that the sensing position determiner 240 may determine a gate line having a lowest ratio GR1 of grayscale data of the red color data among all the gate lines as the sensing target gate line. For example, the sensing position determiner 240 may determine the third gate line having a lowest ratio GR1 (the minimum value among 70%, 60%, 20% and 30%) of grayscale data of the red color data among all the gate lines as the sensing target gate line in FIG. 10.

When the third gate line is determined as the sensing target gate line, the sensing signals of the red subpixels connected to the third gate line may be sensed in a corresponding frame. For example, after sensing the sensing signals of the red subpixels connected to the third gate line, sensing signals of the green subpixels connected to the third gate line and sensing signals of the blue subpixels connected to the third gate line may be sequentially sensed. However, the embodiments described herein may not be limited thereto. In an embodiment, the green color data and the blue color data may be independent of the determination of the sensing target gate line.

For example, the driving controller 200 may determine a gate line having a lowest ratio of grayscale data of the red color data among all the gate lines as a first sensing target gate line in a first frame. In a vertical blank period of the first frame, the sensing signal of the red subpixels connected to the first sensing target gate line may be sensed.

For example, the driving controller 200 may determine a gate line having a lowest ratio of grayscale data of the red color data among all the gate lines except for the first sensing target gate line as a second sensing target gate line in a second frame. In a vertical blank period of the second frame, the sensing signal of the red subpixels connected to the second sensing target gate line may be sensed.

When the sensing of all gate lines is finished in this way, the process moves to the step of determining the first sensing target gate line again, and the sensing operation may be repetitively operated.

In FIG. 11, the first image I1 and the third image I3 may be a black image. The second image I2 includes a red box pattern RED in a black background. The fourth image I4 is a gray image. An upper portion A1 of the second image I2 and a lower portion A3 of the second image I2 may include a black image. However, a middle portion A2 of the second image I2 may include the red box pattern RED.

Each of the first image I1, the second image I2, the third image I3 and the fourth image I4 may be displayed for a predetermined time (e.g. for several frames or for several tens of frames). The first image I1, the second image I2, the third image I3 and the fourth image I4 may be sequentially displayed.

According to the embodiment described herein, in a period when the red box pattern RED is displayed (e.g. in a display period of I2), the upper portion A1 or the lower portion A3 in which the red box pattern RED is not displayed may be mainly sensed. In contrast, in a period when the red box pattern RED is not displayed (e.g. in a display periods of I1 and I3), the middle portion A2 in which the red box pattern RED is not displayed may be mainly sensed. Accordingly, when the middle portion A2 including the red box pattern RED of the second image I2 is displayed, the middle portion A2 of the second image I2 may not be sensed so that the accuracy of the compensation may not be decreased.

The fourth image I4 in FIG. 11 may not be affected by the red box pattern RED of the second image I2 so that the fourth image I4 may represent a first luminance L1 as a whole unlike FIG. 8. Herein, the first luminance L1 may be a desired luminance of the fourth image I4.

According to the embodiment described herein, the input image data IMG may be analyzed to determine the sensing horizontal line which is a sensing target so that the accuracy of the sensing and the accuracy of the image compensation may be enhanced.

For example, in the pixel structure in which the red subpixel overlaps the sensing line SL, the horizontal line having the low data density of the red subpixel is determined as the sensing horizontal line so that the accuracy of the sensing and the accuracy of the image compensation may be enhanced. Thus, the display quality of the display panel 100 may be enhanced.

FIG. 12 is a conceptual diagram illustrating an image analysis table generated by a driving controller 200 of a display apparatus according to an embodiment.

The display apparatus according to the embodiment described with reference to FIG. 12 is substantially the same as the display apparatus of the previous embodiment explained referring to FIGS. 1 to 11 except for the operation of the driving controller. Thus, the same reference numerals will be used to refer to the same or like parts as those described in the previous embodiment of FIGS. 1 to 11 and any repetitive explanation concerning the above elements will be omitted for sake of clarity.

Referring to FIGS. 1 to 9, 11 and 12, the display apparatus includes a display panel 100 and a display panel driver. The display panel driver includes a driving controller 200, a gate driver 300, a gamma reference voltage generator 400 and a data driver 500.

The display panel 100 may include a first color subpixel, a second color subpixel and a third color subpixel. For example, the first color subpixel may be a red subpixel, the second color subpixel may be a green subpixel and the third color subpixel may be a blue subpixel.

In the embodiment described herein, the sensing line SL may overlap the red subpixel. For example, the sensing line SL may overlap the light emitting area RA of the red subpixel.

The driving controller 200 may determine the sensing target gate line among all of the gate lines based on the first color data corresponding to the first color subpixel, the second color data corresponding to the second color subpixel and the third color data corresponding to the third color subpixel.

For example, the driving controller 200 may include an image analyzer 220 analyzing the input image data IMG and generating the image analysis table TB and a sensing position determiner 240 determining the sensing target gate line GLN based on the image analysis table TB.

The image analyzer 220 may determine a data density. The image analyzer 220 may determine an average value GR2 of grayscale data of the first color data, an average value GG2 of grayscale data of the second color data and an average value GB2 of grayscale data of the third color data in each gate line. For example, the first color data may be red color data, the second color data may be green color data and the third color data may be blue color data.

In FIG. 12, an average value GR2 of grayscale data of the red subpixel connected to a first gate line, an average value GG2 of grayscale data of the green subpixel connected to the first gate line, an average value GB2 of grayscale data of the blue subpixel connected to the first gate line may be respectively 150, 0 and 0.

In FIG. 12, an average value GR2 of grayscale data of the red subpixel connected to a second gate line, an average value GG2 of grayscale data of the green subpixel connected to the second gate line, an average value GB2 of grayscale data of the blue subpixel connected to the second gate line may be respectively 130, 20 and 15.

In FIG. 12, an average value GR2 of grayscale data of the red subpixel connected to a third gate line, an average value GG2 of grayscale data of the green subpixel connected to the third gate line, an average value GB2 of grayscale data of the blue subpixel connected to the third gate line may be respectively 15, 200 and 180.

In FIG. 12, an average value GR2 of grayscale data of the red subpixel connected to a 2160-th gate line, an average value GG2 of grayscale data of the green subpixel connected to the 2160-th gate line, an average value GB2 of grayscale data of the blue subpixel connected to the 2160-th gate line may be respectively 255, 255 and 0.

In the embodiment described herein, the sensing line SL overlaps the red subpixel so that the sensing position determiner 240 may determine a gate line having a lowest average value GR2 of grayscale data of the red color data among all the gate lines as the sensing target gate line. For example, the sensing position determiner 240 may determine the third gate line having a lowest average value GR2 (the minimum value among 150, 130, 15 and 255) of grayscale data of the red color data among all the gate lines as the sensing target gate line in FIG. 12.

According to the embodiment described herein, the input image data IMG may be analyzed to determine the sensing horizontal line which is a sensing target so that the accuracy of the sensing and the accuracy of the image compensation may be enhanced.

For example, in the pixel structure in which the red subpixel overlaps the sensing line SL, the horizontal line having the low data density of the red subpixel is determined as the sensing horizontal line so that the accuracy of the sensing and the accuracy of the image compensation may be enhanced. Thus, the display quality of the display panel 100 may be enhanced.

FIG. 13 is a conceptual diagram illustrating an image analysis table generated by a driving controller 200 of a display apparatus according to an embodiment The display apparatus according to the embodiment with reference to FIG. 13 is substantially the same as the display apparatus of the previous embodiment explained referring to FIGS. 1 to 11 except for the operation of the driving controller. Thus, the same reference numerals will be used to refer to the same or like parts as those described in the previous embodiment of FIGS. 1 to 11 and any repetitive explanation concerning the above elements will be omitted for sake of brevity.

Referring to FIGS. 1 to 9, 11 and 13, the display apparatus includes a display panel 100 and a display panel driver. The display panel driver includes a driving controller 200, a gate driver 300, a gamma reference voltage generator 400 and a data driver 500.

The display panel 100 may include a first color subpixel, a second color subpixel and a third color subpixel. For example, the first color subpixel may be a red subpixel, the second color subpixel may be a green subpixel and the third color subpixel may be a blue subpixel.

In the embodiment described herein, the sensing line SL may overlap the red subpixel. For example, the sensing line SL may overlap the light emitting area RA of the red subpixel.

The driving controller 200 may determine the sensing target gate line among all of the gate lines based on the first color data corresponding to the first color subpixel, the second color data corresponding to the second color subpixel and the third color data corresponding to the third color subpixel.

For example, the driving controller 200 may include an image analyzer 220 analyzing the input image data IMG and generating the image analysis table TB and a sensing position determiner 240 determining the sensing target gate line GLN based on the image analysis table TB.

The image analyzer 220 may determine a data density. The image analyzer 220 may determine a ratio PR1 of a number of first color subpixels among subpixels having a grayscale value equal to or greater than a threshold grayscale value, a ratio PG1 of a number of second color subpixels among the subpixels having a grayscale value equal to or greater than the threshold grayscale value and a ratio PB1 of a number of third color subpixels among the subpixels having a grayscale value equal to or greater than the threshold grayscale value in each gate line. For example, the subpixel having a grayscale value equal to or greater than the threshold grayscale value may mean a turned-on subpixel. For example, the threshold grayscale value may be a middle grayscale value (e.g. a grayscale value of 127 when a full grayscale value is 255).

In the embodiment described herein, the sensing line SL overlaps the red subpixel so that the sensing position determiner 240 may determine a gate line having a lowest ratio PR1 of the number of turned-on red subpixels among all the gate lines as the sensing target gate line. For example, the sensing position determiner 240 may determine the second gate line having a lowest ratio PR1 (the minimum value among 30%, 10%, 60% and 70%) of the number of turned-on red subpixels among all the gate lines as the sensing target gate line in FIG. 13.

According to the embodiment described herein, the input image data IMG may be analyzed to determine the sensing horizontal line which is a sensing target so that the accuracy of the sensing and the accuracy of the image compensation may be enhanced.

For example, in the pixel structure in which the red subpixel overlaps the sensing line SL, the horizontal line having the low data density of the red subpixel is determined as the sensing horizontal line so that the accuracy of the sensing and the accuracy of the image compensation may be enhanced. Thus, the display quality of the display panel 100 may be enhanced.

FIG. 14 is a conceptual diagram illustrating an image analysis table generated by a driving controller 200 of a display apparatus according to an embodiment.

The display apparatus according to the embodiment with reference to FIG. 14 is substantially the same as the display apparatus of the previous embodiment explained referring to FIGS. 1 to 11 except for the operation of the driving controller. Thus, the same reference numerals will be used to refer to the same or like parts as those described in the previous embodiment of FIGS. 1 to 11 and any repetitive explanation concerning the above elements will be omitted for sake of brevity.

Referring to FIGS. 1 to 9, 11 and 14, the display apparatus includes a display panel 100 and a display panel driver. The display panel driver includes a driving controller 200, a gate driver 300, a gamma reference voltage generator 400 and a data driver 500.

The display panel 100 may include a first color subpixel, a second color subpixel and a third color subpixel. For example, the first color subpixel may be a red subpixel, the second color subpixel may be a green subpixel and the third color subpixel may be a blue subpixel.

In the embodiment described herein, the sensing line SL may overlap the red subpixel. For example, the sensing line SL may overlap the light emitting area RA of the red subpixel.

The driving controller 200 may determine the sensing target gate line among all of the gate lines based on the first color data corresponding to the first color subpixel, the second color data corresponding to the second color subpixel and the third color data corresponding to the third color subpixel.

For example, the driving controller 200 may include an image analyzer 220 analyzing the input image data IMG and generating the image analysis table TB and a sensing position determiner 240 determining the sensing target gate line GLN based on the image analysis table TB.

The image analyzer 220 may determine a data density. The image analyzer 220 may determine a number PR2 of first color subpixels among subpixels having a grayscale value equal to or greater than a threshold grayscale value, a number PG2 of second color subpixels among the subpixels having a grayscale value equal to or greater than the threshold grayscale value and a number PB2 of third color subpixels among the subpixels having a grayscale value equal to or greater than the threshold grayscale value in each gate line. For example, the subpixel having a grayscale value equal to or greater than the threshold grayscale value may mean a turned-on subpixel. For example, the threshold grayscale value may be a middle grayscale value (e.g. a grayscale value of 127 when a full grayscale value is 255).

In the embodiment described herein, the sensing line SL overlaps the red subpixel so that the sensing position determiner 240 may determine a gate line having a lowest number PR2 of turned-on red subpixels among all the gate lines as the sensing target gate line. For example, the sensing position determiner 240 may determine the second gate line having a lowest number (the minimum value among 250, 20, 350 and 60) of the turned-on red subpixels among all the gate lines as the sensing target gate line in FIG. 14.

According to the embodiment described herein, the input image data IMG may be analyzed to determine the sensing horizontal line which is a sensing target so that the accuracy of the sensing and the accuracy of the image compensation may be enhanced.

For example, in the pixel structure in which the red subpixel overlaps the sensing line SL, the horizontal line having the low data density of the red subpixel is determined as the sensing horizontal line so that the accuracy of the sensing and the accuracy of the image compensation may be enhanced. Thus, the display quality of the display panel 100 may be enhanced.

Figure 15:
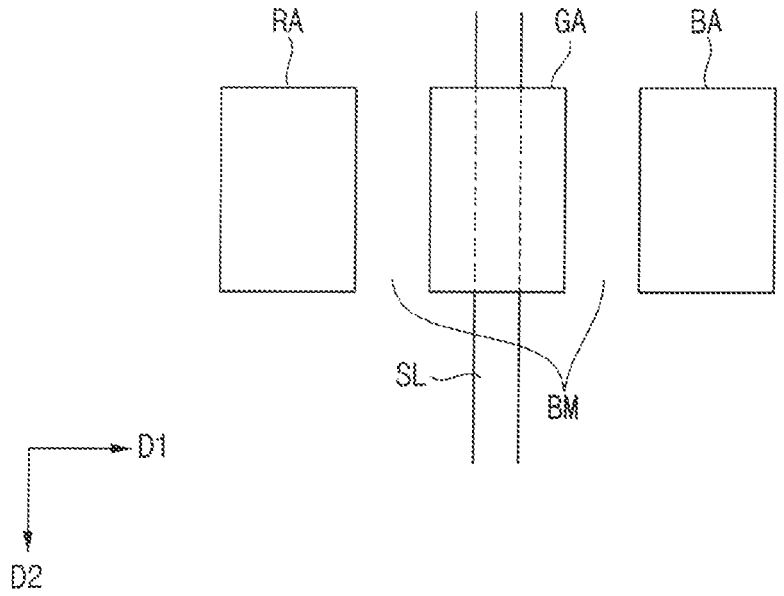
FIG. 15 is a conceptual diagram illustrating an arrangement of subpixels and a sensing line of a display panel of a display apparatus according to an embodiment

FIG. 15 is a conceptual diagram illustrating an arrangement of subpixels and a sensing line SL of a display panel 100 of a display apparatus according to an embodiment.

The display apparatus according to the embodiment with reference to FIG. 15 is substantially the same as the display apparatus of the previous embodiment explained referring to FIGS. 1 to 11 except for the pixel structure. Thus, the same reference numerals will be used to refer to the same or like parts as those described in the previous embodiment of FIGS. 1 to 11 and any repetitive explanation concerning the above elements will be omitted for sake of brevity.

Referring to FIGS. 1 to 6, 9 and 15, the display apparatus includes a display panel 100 and a display panel driver. The display panel driver includes a driving controller 200, a gate driver 300, a gamma reference voltage generator 400 and a data driver 500.

The display panel 100 may include a first color subpixel, a second color subpixel and a third color subpixel. For example, the first color subpixel may be a red subpixel, the second color subpixel may be a green subpixel and the third color subpixel may be a blue subpixel.

In the embodiment described herein, the sensing line SL may overlap the green subpixel. For example, the sensing line SL may overlap the light emitting area GA of the green subpixel.

The image analyzer 220 may determine a data density. In the embodiment described herein, the sensing line SL overlaps the green subpixel so that the sensing position determiner 240 may determine a gate line having a lowest ratio GG1 of grayscale data of the green color data among all the gate lines as the sensing target gate line.

For example, when the image analysis table of FIG. 10 is applied to the embodiment described herein, the sensing position determiner 240 may determine the first gate line or the second gate line having a lowest ratio GG1 (the minimum value among 20%, 20%, 70% and 40%) of grayscale data of the green color data among all the gate lines as the sensing target gate line.

Similarly, the image analysis tables of FIGS. 12, 13 and 14 may be also applied to the embodiment described herein, in which the sensing line SL overlaps the green subpixel.

According to the embodiment described herein, the input image data IMG may be analyzed to determine the sensing horizontal line which is a sensing target so that the accuracy of the sensing and the accuracy of the image compensation may be enhanced.

Figure 16:
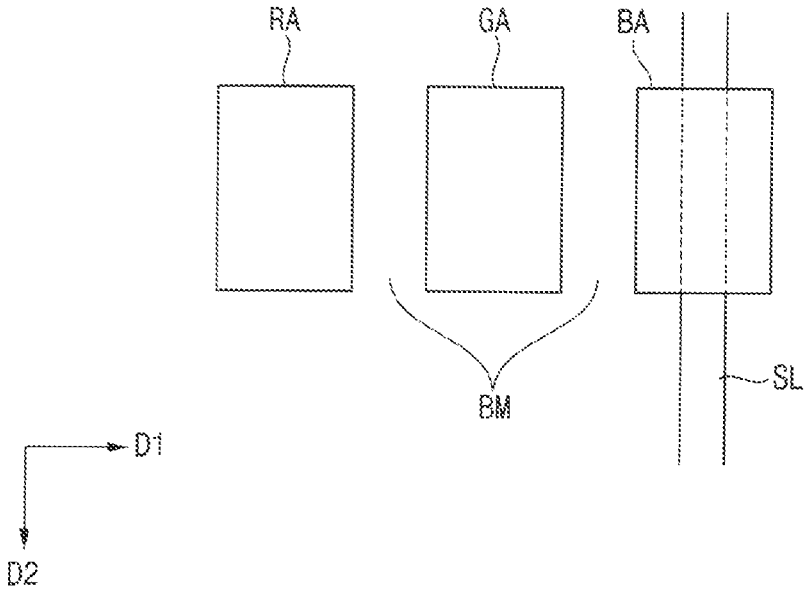
FIG. 16 is a conceptual diagram illustrating an arrangement of subpixels and a sensing line of a display panel of a display apparatus according to an embodiment.

FIG. 16 is a conceptual diagram illustrating an arrangement of subpixels and a sensing line SL of a display panel 100 of a display apparatus according to an embodiment.

The display apparatus according to the embodiment with reference to FIG. 16 is substantially the same as the display apparatus of the previous embodiment explained referring to FIGS. 1 to 11 except for the pixel structure. Thus, the same reference numerals will be used to refer to the same or like parts as those described in the previous embodiment of FIGS. 1 to 11 and any repetitive explanation concerning the above elements will be omitted for sake of brevity.

Referring to FIGS. 1 to 6, 9 and 16, the display apparatus includes a display panel 100 and a display panel driver. The display panel driver includes a driving controller 200, a gate driver 300, a gamma reference voltage generator 400 and a data driver 500.

The display panel 100 may include a first color subpixel, a second color subpixel and a third color subpixel. For example, the first color subpixel may be a red subpixel, the second color subpixel may be a green subpixel and the third color subpixel may be a blue subpixel.

In the embodiment described herein, the sensing line SL may overlap the blue subpixel. For example, the sensing line SL may overlap the light emitting area BA of the blue subpixel.

The image analyzer 220 may determine a data density. In the embodiment described herein, the sensing line SL overlaps the blue subpixel so that the sensing position determiner 240 may determine a gate line having a lowest ratio GB1 of grayscale data of the blue color data among all the gate lines as the sensing target gate line.

For example, when the image analysis table of FIG. 10 is applied to the embodiment described herein, the sensing position determiner 240 may determine the first gate line or the third gate line having a lowest ratio GB1 (the minimum value among 10%, 20%, 10% and 30%) of grayscale data of the blue color data among all the gate lines as the sensing target gate line.

Similarly, the image analysis tables of FIGS. 12, 13 and 14 may be also applied to the embodiment in which the sensing line SL overlaps the blue subpixel.

According to the embodiment described herein, the input image data IMG may be analyzed to determine the sensing horizontal line that is a sensing target so that the accuracy of the sensing and the accuracy of the image compensation may be enhanced.

Figure 17:
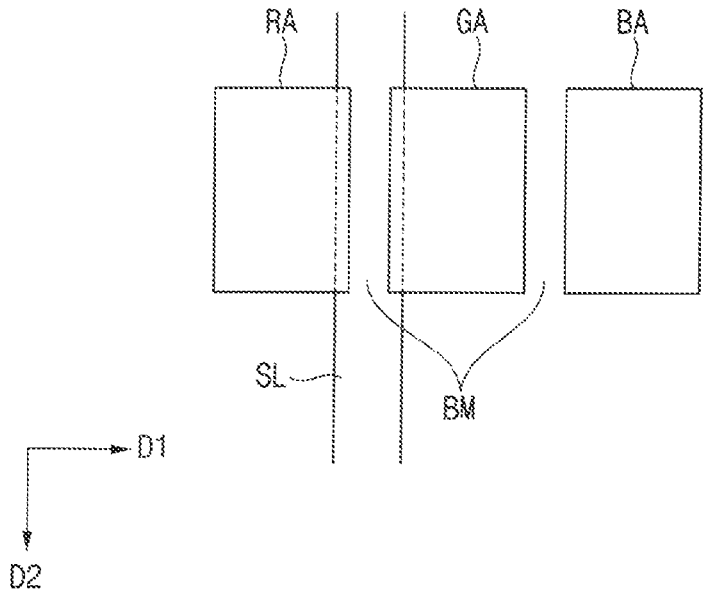
FIG. 17 is a conceptual diagram illustrating an arrangement of subpixels and a sensing line of a display panel of a display apparatus according to an embodiment.

FIG. 17 is a conceptual diagram illustrating an arrangement of subpixels and a sensing line SL of a display panel 100 of a display apparatus according to an embodiment.

The display apparatus according to the with reference to FIG. 17 is substantially the same as the display apparatus of the previous embodiment explained referring to FIGS. 1 to 11 except for the pixel structure. Thus, the same reference numerals will be used to refer to the same or like parts as those described in the previous embodiment of FIGS. 1 to 11 and any repetitive explanation concerning the above elements will be omitted for sake of brevity.

Referring to FIGS. 1 to 6, 9 and 17, the display apparatus includes a display panel 100 and a display panel driver. The display panel driver includes a driving controller 200, a gate driver 300, a gamma reference voltage generator 400 and a data driver 500.

The display panel 100 may include a first color subpixel, a second color subpixel and a third color subpixel. For example, the first color subpixel may be a red subpixel, the second color subpixel may be a green subpixel and the third color subpixel may be a blue subpixel.

In the embodiment described herein, the sensing line SL may overlap the red subpixel and the green subpixel. For example, the sensing line SL may overlap the light emitting area RA of the red subpixel and the light emitting area GA of the green subpixel.

The image analyzer 220 may determine a data density. In the embodiment described herein, the sensing line SL overlaps the red subpixel and the green subpixel so that the sensing position determiner 240 may determine a gate line having a lowest sum of a ratio GR1 of grayscale data of the red color data and a ratio GG1 of grayscale data of the green color data among all the gate lines as the sensing target gate line.

For example, when the image analysis table of FIG. 10 is applied to the embodiment described herein, the sensing position determiner 240 may determine the 2160-th gate line having a lowest sum (the minimum value among 90%, 80%, 90% and 70%) of the ratio GR1 of grayscale data of the red color data and the ratio GG1 of grayscale data of the green color data among all the gate lines as the sensing target gate line.

Similarly, the image analysis tables of FIGS. 12, 13 and 14 may be also applied to the embodiment described herein in which the sensing line SL overlaps the red subpixel and the green subpixel.

Although the sensing line SL overlaps the red subpixel and the green subpixel in the embodiment described herein, the embodiments described herein may not be limited thereto. Alternatively, the sensing line SL may overlap the green subpixel and the blue subpixel. Alternatively, the sensing line SL may overlap the blue subpixel and the red subpixel.

According to the embodiment described herein, the input image data IMG may be analyzed to determine the sensing horizontal line which is a sensing target so that the accuracy of the sensing and the accuracy of the image compensation may be enhanced.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display apparatus comprising:

a display panel including a gate line, a data line, a sensing line and a subpixel connected to the gate line, the data line and the sensing line;

a gate driver configured to output a gate signal to the gate line;

a data driver configured to output a data voltage to the data line; and a driving controller configured to control the gate driver and the data driver;

wherein the display panel includes a first color subpixel, a second color subpixel and a third color subpixel, and wherein the driving controller is configured to determine a sensing target gate line among a plurality of gate lines of the display panel based on first color data corresponding to the first color subpixel, second color data corresponding to the second color subpixel and third color data corresponding to the third color subpixel.

2. The display apparatus of claim 1, wherein the sensing line overlaps the first color subpixel.

3. The display apparatus of claim 2, wherein the driving controller is configured to determine a ratio of grayscale data of the first color data, a ratio of grayscale data of the second color data and a ratio of grayscale data of the third color data in each gate line.

4. The display apparatus of claim 3, wherein the driving controller is configured to determine a gate line having a lowest ratio of the grayscale data of the first color data among the plurality of gate lines as a first sensing target gate line in a first frame.

5. The display apparatus of claim 4, wherein the driving controller is configured to determine a gate line having a lowest ratio of the grayscale data of the first color data among the plurality of gate lines except for the first sensing target gate line as a second sensing target gate line in a second frame.

6. The display apparatus of claim 2, wherein the driving controller is configured to determine an average value of grayscale data of the first color data, an average value of grayscale data of the second color data and an average value of grayscale data of the third color data in each gate line.

7. The display apparatus of claim 2, wherein the driving controller is configured to determine a ratio of a number of the first color subpixels among subpixels having a grayscale value equal to or greater than a threshold grayscale value, a ratio of a number of the second color subpixels among the subpixels having a grayscale value equal to or greater than the threshold grayscale value and a ratio of a number of the third color subpixels among the subpixels having a grayscale value equal to or greater than the threshold grayscale value in each gate line.

8. The display apparatus of claim 2, wherein the driving controller is configured to determine a number of the first color subpixels among subpixels having a grayscale value equal to or greater than a threshold grayscale value, a number of the second color subpixels among the subpixels having a grayscale value equal to or greater than the threshold grayscale value and a number of the third color subpixels among the subpixels having a grayscale value equal to or greater than the threshold grayscale value in each gate line.

9. The display apparatus of claim 2, wherein the first color subpixel is a red subpixel, wherein the second color subpixel is a green subpixel, and wherein the third color subpixel is a blue subpixel.

10. The display apparatus of claim 2, wherein the first color subpixel is a green subpixel, wherein the second color subpixel is a red subpixel, and wherein the third color subpixel is a blue subpixel.

11. The display apparatus of claim 2, wherein the first color subpixel is a blue subpixel, wherein the second color subpixel is a red subpixel, and wherein the third color subpixel is a green subpixel.

12. The display apparatus of claim 1, wherein the sensing line overlaps the first color subpixel and the second color subpixel.

13. The display apparatus of claim 12, wherein the driving controller is configured to determine a ratio of grayscale data of the first color data, a ratio of grayscale data of the second color data and a ratio of grayscale data of the third color data in each gate line, and wherein the driving controller is configured to determine a gate line having a lowest sum of the ratio of the grayscale data of the first color data and the ratio of the grayscale data of the second color data among the plurality of gate lines as a first sensing target gate line in a first frame.

14. The display apparatus of claim 1, wherein the subpixel comprises:

a first transistor configured to apply a first power voltage to a second node in response to a signal at a first node;

a second transistor configured to output the data voltage to the first node in response to a first signal;

a third transistor configured to output a signal at the second node to the sensing line in response to a second signal;

a storage capacitor including a first end portion connected to the first node and a second end portion connected to the second node; and a light emitting element including a first electrode connected to the second node and a second electrode configured to receive a second power voltage.

15. The display apparatus of claim 14, further comprising an initialization switch configured to apply a sensing initialization voltage to the sensing line in response to a third signal, wherein the first signal has an active level and the second signal has an inactive level in a writing mode, and wherein the first signal has the active level and the second signal has an active level and the third signal has an inactive level in a sensing mode.

16. The display apparatus of claim 1, wherein the display apparatus is driven in a unit of a frame, wherein the frame includes an active period and a vertical blank period, and wherein the subpixel is sensed during the vertical blank period.

17. A method of driving a display apparatus, the method comprising:

outputting a gate signal to a gate line of a display panel, the display panel comprising a first color subpixel, a second color subpixel and a third color subpixel;

outputting a data voltage to a data line of the display panel;

determining a sensing target gate line among a plurality of gate lines of the display panel based on first color data corresponding to the first color subpixel, second color data corresponding to the second color subpixel and third color data corresponding to the third color subpixel;

receiving a sensing signal from a sensing line of a subpixel corresponding to the sensing target gate line; and compensating a data signal based on the sensing signal.

18. The method of claim 17, wherein the sensing line overlaps the first color subpixel.

19. The method of claim 18, further comprising determining a ratio of grayscale data of the first color data, a ratio of grayscale data of the second color data and a ratio of grayscale data of the third color data in each gate line.

20. The method of claim 19, wherein a gate line having a lowest ratio of the grayscale data of the first color data among the plurality of gate lines is determined as a first sensing target gate line in a first frame.

* * * * *